United States Patent [19]

Cox

[11] Patent Number: 4,871,088

[45] Date of Patent: Oct. 3, 1989

[54] PNEUMATIC DISPENSERS FOR VISCOUS MATERIALS

[75] Inventor: John P. A. Cox, Hungerford, England

[73] Assignee: P.C. Cox (New bury) Limited, Berkshire, United Kingdom

[21] Appl. No.: 190,589

[22] Filed: May 5, 1988

Related U.S. Application Data

[63] Continuation of Ser. No. 20,484, Mar. 2, 1987, abandoned.

[30] Foreign Application Priority Data

Mar. 3, 1986 [GB] United Kingdom ..... 8605210

[51] Int. Cl.[4] ..... B67D 5/22

[52] U.S. Cl. ..... 222/47; 222/136; 222/137; 222/333; 222/326

[58] Field of Search ..... 222/47, 49, 135, 137, 222/145, 326, 327, 136, 333, 389; 239/322

[56] References Cited

U.S. PATENT DOCUMENTS

| | | | |
|---|---|---|---|
| 923,550 | 6/1909 | Mikofey | 222/389 |
| 1,648,163 | 11/1927 | Childs | 222/389 |
| 2,692,706 | 10/1954 | Wiksten | 222/389 |
| 2,943,768 | 7/1960 | Lindsey | 222/327 |
| 3,159,312 | 12/1964 | Sciver | 222/137 |
| 3,504,826 | 4/1970 | Carlton | 222/327 |
| 3,983,947 | 10/1976 | Wills et al. | 222/389 |
| 4,067,479 | 1/1978 | Moline | 222/137 |
| 4,538,920 | 9/1985 | Drake | 222/137 |
| 4,631,055 | 12/1986 | Redl et al. | 222/135 |
| 4,676,410 | 6/1987 | Flue | 222/137 |

*Primary Examiner*—H. Grant Skaggs

*Attorney, Agent, or Firm*—Price, Heneveld, Cooper, DeWitt & Litton

[57] ABSTRACT

A pneumatic dispenser gun for two part viscous materials comprising two parallel containers containing the two materials and a pneumatic cylinder 12 whose axis is parallel to the axes of the two containers and which contains a piston 15 having symmetrically mounted piston rods 17, 18 extending through the end wall of the cylinder into the containers to expel the contents of the two containers simultaneously through a common outlet passage. A further rod 19 extends from the piston parallel to the piston rods but outside the containers to provide an indication of the amount of contents remaining in the containers and a handle for returning the piston to its initial position.

1 Claim, 5 Drawing Sheets

PNEUMATIC DISPENSERS FOR VISCOUS MATERIALS

This is a continuation of application Serial No. 020,484, filed Mar. 2, 1987, now abandoned.

This invention relates to pneumatic dispensers for viscous materials which may be of a thick liquid nature or a pasty nature and which are in multi-part or multi-component form, particularly those in two part form. Certain viscous materials such as some adhesives are in two part form, the two parts being mixed shortly before application. For some years one part viscous materials have been packaged in cylindrical cartridges, the contents of the cartridge being dispensed by means of a hand-operated gun- in which the cartridge is mounted and which moves a piston rod into the open rear end of the cartridge against a piston sliding in the cartridge, the contents of the cartridge being expelled from the other end of the cartridge through a nozzle which forms either part of the cartridge or of the gun. Similar dispensing means have been used recently for two part materials in which the two parts are contained in a single cartridge divided into two concentric compartments by an internal cylindrical wall to provide a central cylindrical compartment and an outer annular compartment, the gun being provided with means for simultaneously moving concentric central circular and outer annular pistons and the two compartments communicating with a common mixer nozzle.

The application of two part materials with such dispensing means is expensive since the construction of the cartridge is complex. It has also been found that for some two part components the usual construction of hand-operated dispenser gun used for single part materials requires excessive manual effort to drive out the two components through a common mixture nozzle, particularly since the nozzle will usually contain a static mixer to ensure that the two parts are mixed homogeneously.

When dispensing material with a pneumatic gun, as opposed to the usual hand operated gun, it is not possible to determine visually how much material has already been dispensed. Also, the means for returning the dispensing means to its initial position which exists in a manual gun is not present in a pneumatic gun.

According to the present invention, a pnuematic dispenser for a multi-part viscous material comprises a pneumatic cylinder containing a piston carrying parallel piston rods extending from one end of the cylinder, a plurality of parallel cylindrical containers mounted on the cylinder and extending away from the said one end of the cylinder respectively to contain the parts of the material with their axes parallel to the axis of the pneumatic cylinder and with the piston rods extending respectively into the containers, and a further rod carried by the piston and extending from the said one end of the cylinder parallel with the piston rods and alongside the containers. The further rod will provide an indication of the location of the pistons within the containers and may be used to return the piston to the rear end of the pneumatic cylinder.

Preferably, the axes of the piston rods are evenly spaced around a circle with the axis of the pneumatic piston as centre. This will usually provide the best balance of forces.

In one possible construction of the dispenser, the containers are formed by separate cylindrical cartridges and the cylinder comprises a plurality of side-by-side mountings for the cartridge. In this case, the dispenser may include a pivoted yoke having retaining means at its forward end to releasably retain the cartridges within the mounting means. In another possible construction, the containers are provided by a common cartridge and the cylinder comprises a mounting for the cartridge.

The invention may be carried into practice in various ways but two pneumatic dispensers embodying the invention will now be described by way of example with reference to the accompanying drawings, in which.

Figure 1:
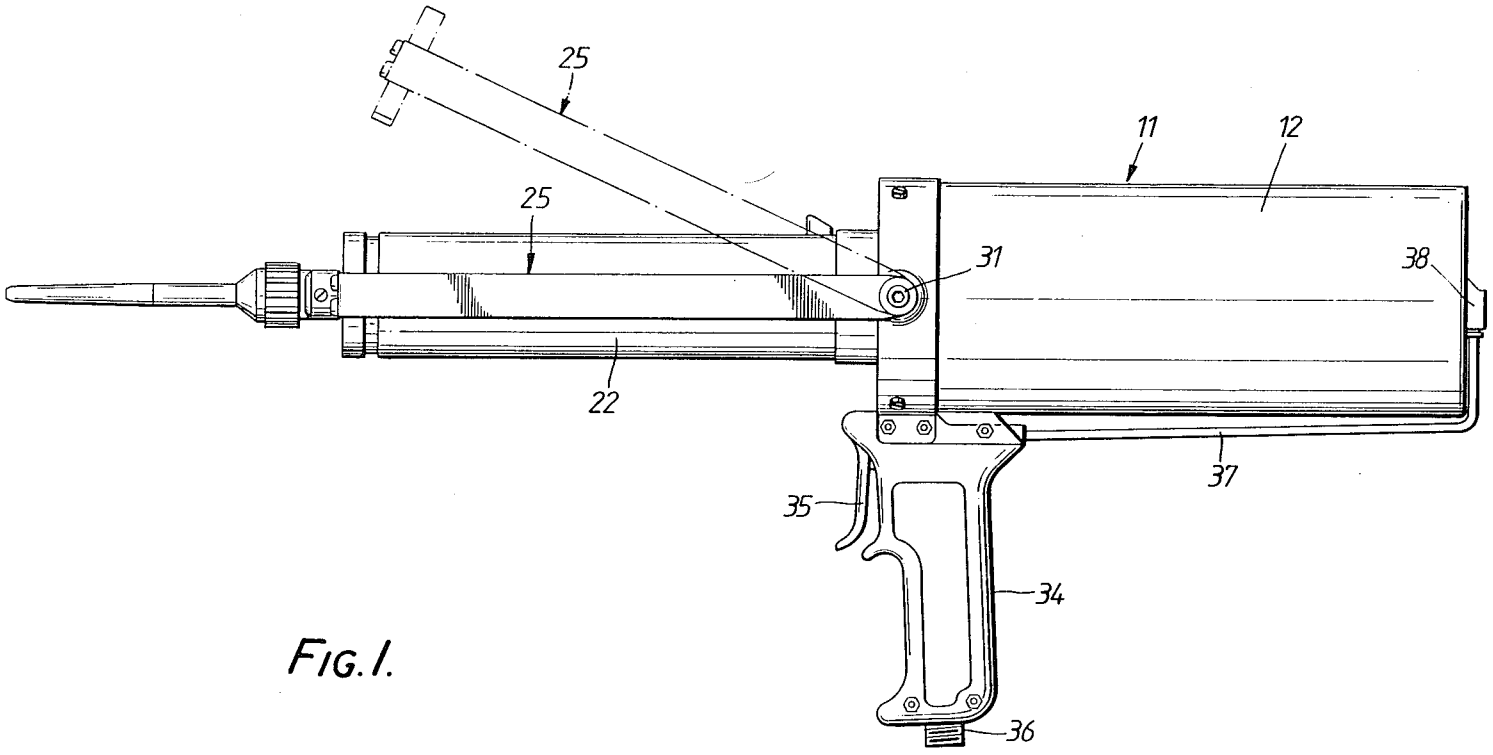
FIG. 1 is a side view of the first dispenser with cartridges about to be inserted in mounting means.
Figure 2:
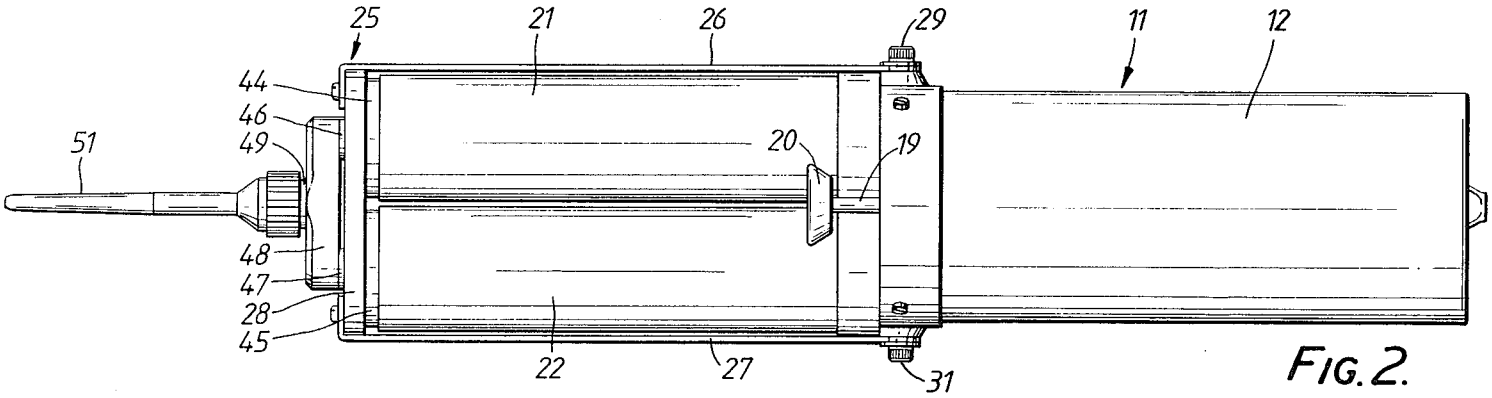
FIG. 2 is a plan view of the dispenser shown in FIG. 1 with cartridges about to be inserted into the mounting means.
Figure 4:
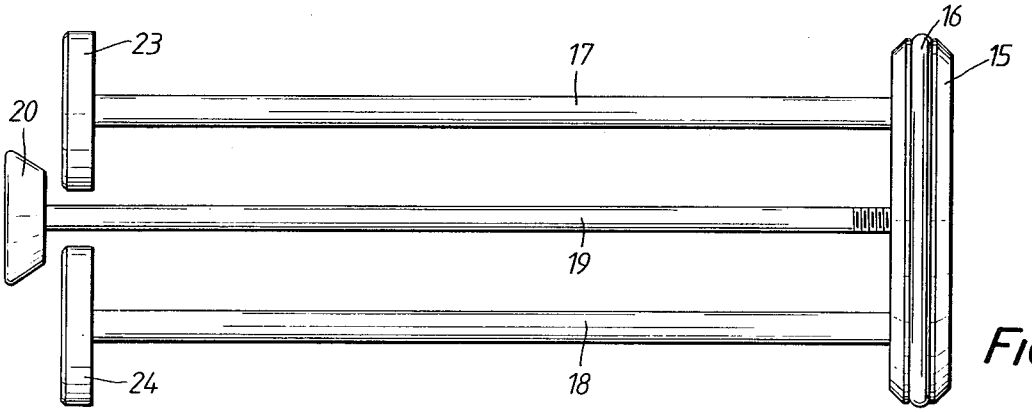
FIG. 4 is a plan view of the piston assembly forming part of the dispenser shown in FIGS. 1 to 3.
Figure 3:
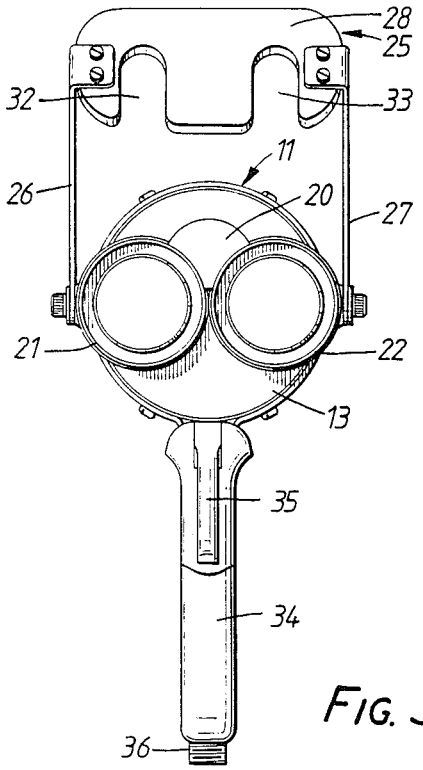
FIG. 3 is a front end view of the dispenser shown in FIGS. 1 and 2 with no cartridges in position.

The pneumatic dispenser gun shown in FIGS. 1 to 5 of the drawings comprises a pneumatic cylinder 11 having a barrel 12, a front end wall 13 and a rear end wall 14, and containing a pneumatic piston 15 fitted with a piston ring 16 in the form of a rubber 0-ring. The piston 15 carries two piston rods 17, 18 whose axes intersect a common diameter of the piston and are at equal distances from the axis of the piston 15, the piston rods passing through closely fitting apertures in the front wall 13 which thus provide piston rod bearings. The piston carries a third or further rod and whose axis intersects a radius which is perpendicular to the diameter intersected by the piston rods 17 and 18. The third rod is used to provide a visual indication of the position of the piston rods 17 and 18 and for repositioning the piston 15 as will be explained below.

A pair of tubes forming cartridge mountings 21, 22 are mounted on the front of the front wall 13 coaxially with the piston rods 17 and 18 so that pistons 23, 24 carried on the forward ends of the piston rods 17, 18 can reciprocate in cartridges carried in the mountings 21, 22. The rod 19 which also passes through a closely fitting aperture in the front wall 13 moves in the valley formed between the two mountings 21, 22 and carries at its forward end a button 20 whose periphery is formed of three arcuate surfaces, two of which are concave and engage the respective outer surfaces of the two mountings 21, 22.

A bail 25 is formed of two rigid straps 26, 27 and a yoke 28, the ends of the straps 26, 27 remote from the yoke 28 being pivoted by studs 29, 31 to the barrel 11 adjacent the front wall 13. As can be seen from FIG. 3, the yoke 28 is formed along one edge with two notches 32, 33.

On its underside the barrel 11 carries a handle 34 shaped like a pistol butt and having a finger-operated trigger 35 which controls a pilot valve (not shown) in an air passage running from an inlet 36 which can be connected by a flexible hose to a compressed air system and a transfer pipe 37 leading to an inlet fitting 38 on the rear wall 14 of the barrel 11.

Figure 5:
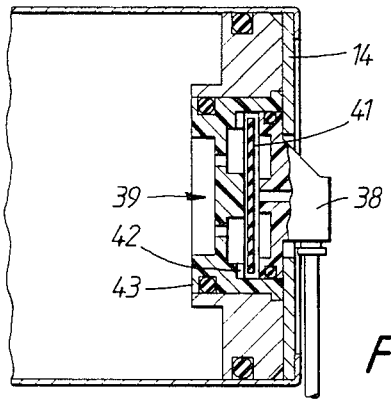
FIG. 5 is a fragmentary side view, partially broken away, of the right hand end of the dispenser as seen in FIG. 1, showing the main operating valve.
Figure 6:
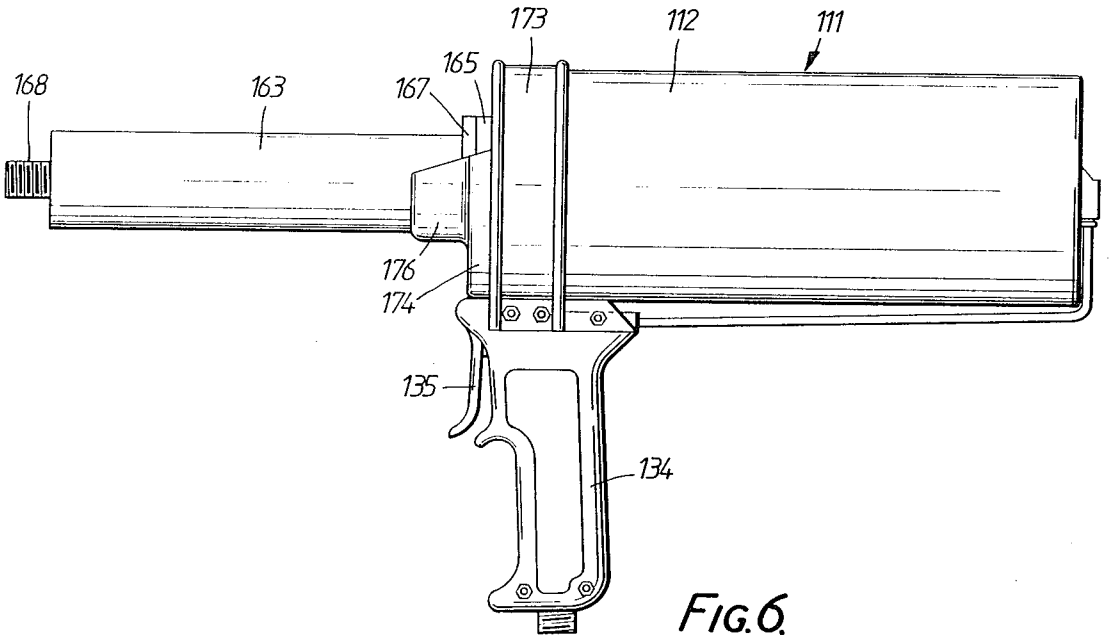
FIG. 6 is a side view similar to FIG. 1 of the second dispenser with a composite cartridge in position.
Figure 9:
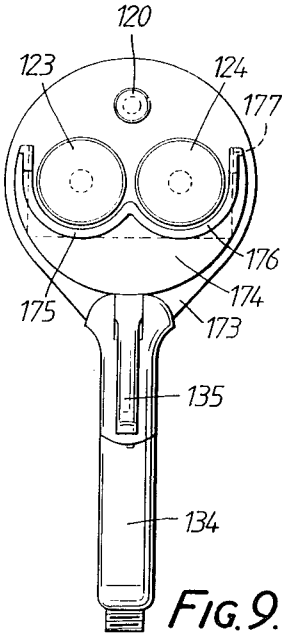
FIG. 9 is a front end view of the second dispenser without the cartridge.

The fitting 38 leads to an inlet and dump valve 39 containing a flexible disc 41. When the trigger 35 is pulled, compressed air is passed through the inlet fitting 38 and moves the disc 41 to the left as seen in FIG. 5. Compressed air can then travel around the edges of the disc 41 through notches 42 in the valve body 43 into the interior of the barrel 12 so that pressure is applied to the rear face of the piston 15. On release of the trigger 35 the pressure in the barrel moves the disc 41 to the right as seen in FIG. 5 thus opening large outlet ports (not shown) which open through the end wall 14 and provide for rapid decompression of the pneumatic cylinder 11.

The dispenser gun is intended for use with a pair of cylindrical cartridges 44, 45 which are received in the mountings 21 and 22 so that their forward ends protrude slightly from the forward ends of the mountings. Each cartridge has an open rear end containing a dish-shaped sealing piston and is closed at the front end by a wall carrying a central screw-threaded outlet boss which is supplied closed with a removable cap. After removal of the caps each of the bosses is threaded into one of two screw-threaded cups 46, 47 forming part of a moulded manifold 48 providing outlet passage means and having flow ducts from the two cups 46, 47 to a central screw threaded boss 49. The boss 49 receives the female screw-threaded rear end of a nozzle 51 which contains a static mixer (not shown) consisting of interconnected inclined plates forming interconnecting passages to provide intimate mixing.

The dispenser un is used as follows. Two full cartridges of different materials which are to be kept separate until required for use and which have to be mixed in a one-to-one ratio immediately prior to use have their sealing caps removed and their forward bosses screwed into the cups 46, 47 on the manifold 48 to which the nozzle 51 has already been attached. With the piston 15 and hence the pistons 23, 24 fully retracted, the cartridges 44, 45 are inserted in the mountings 21, 22 and the bail 25 is moved from the position shown in broken lines in FIG. 1 to the position shown in full lines; the notches 32 and 33 in the yoke 28 fit over the cups 46 and 47 to retain the cartridges within the mountings 21, 22. When material is to be dispensed from the nozzle 51, the trigger 35 is pulled and compressed air is admitted to the barrel 12 to apply pressure to the rear face of the piston 15 which is therefore moved forward so that the pistons 23, 24 acting on the dish-shaped piston seals in the cartridges pressurise the contents of the cartridges. The materials are thus expressed through the outlet bosses and through the manifold 48 into the nozzle 51 where the two materials are intimately mixed before being delivered from the outlet end of the cartridge. When sufficient material has been dispensed, the trigger 35 is released and the dump valve 39 immediately changes over to its dump position to allow the pressure in the barrel 12 to fall almost instantaneously to a pressure which is low enough to relieve the pressure applied by the pistons 23, 24 to the contents of the cartridges.

The barrel 12, the mountings 21 and 22, and the cartridges 44 and 45 are opaque but the position of the button 20 which is outside moves with the piston 23 and 24 and so provides a visual indication of the positions of the piston 23 and 24 to show at any time the proportion of the contents of the cartridges which has been dispensed and the proportion remaining.

When the cartridges are empty, the button 20 is used to manually return the piston 15 to the rear end of the barrel 12, the bail 25 is raised and the empty cartridges are removed.

It will be noted that the load applied by the air pressure to the piston 15 is transferred symmetrically through the piston rods 17, 18 and the pistons 23, 24 to the contents of the cartridges and there will be substantially no transverse loads on any of these components and substantially no tilting loads on the piston 15. For two-component materials which are to be mixed in proportions other than one-to-one and which are contained in cartridges of different diameters, it will be possible to employ mountings which are of corresponding different diameters in which case it would be possible to displace the axis of the piston operating on the smaller cartridge a greater distance from the central axis of the piston 15 than that operating on the larger cartridge to reduce or eliminate any out of balance but the general arrangement is such that some degree of out of balance can be tolerated since in any arrangment the major forces will be axial.

The second form of pneumatic dispenser gun shown in FIGS. 6 to 9 of the drawings comprises a pneumatic cylinder 111 and pistol butt handle 134 which are substantially identical to those of the gun shown in FIGS. 1 to 5. As with that gun, the dispenser includes a trigger 135 which controls flow of compressed air to an inlet and dump valve identical to that shown in FIG. 5. The details of the compressed air control will not be described again. The cylinder 111 has a barrel 112 which contains a piston 115 which is identical to that shown in FIG. 4 and carries two piston rods 117 and 118 and a third rod 119 which are similar to those shown in FIG. 4 but which are positioned relative to the axis of the piston slightly differently. The piston rods 117, 118 carry at their forward ends pistons 123 and 124 while the further rod 119 carries a button 120.

Whereas the dispenser shown in FIGS. 1 to 5 is intended to be used with individual cylindrical cartridges, that shown in FIGS. 6 to 9 is used with a single composite cartrige 161 which is formed as a single plastics moulding. It comprises essentially two cylindrical chambers 162 and 163 which are merged together along a line of contact and are open at the rear end and generally closed at the front end by a front end wall 164. At the rear end the cartridge is formed with an integral rectangular flange 165 adjacent each end of which there is an upstanding forwardly facing flange wall 166, 167. The front wall 164 carries a forwardly extending boss 168 which is threaded on the outside and whose interior is divided into two by a septum wall 169 each of the semicircular passages formed by the septum wall being connected with the interior of a respective one of the two chambers 162, 163 by passages 171, 172 in the end wall 164.

The barrel 112 is secured to the handle 134 by a collar 173 which surrounds and grips the forward end of the barrel 112 and is formed with an integral cradle and cartridge retainer 174 which consists essentially of a forwardly directed flange having two arcuate sections 175 and 176 on which the undersides of the cradles 162, 163 rest and having a groove 175 which forms three sides of a rectangle and receives the flange 165 on the rear end of the cartridge 161.

Figure 7:
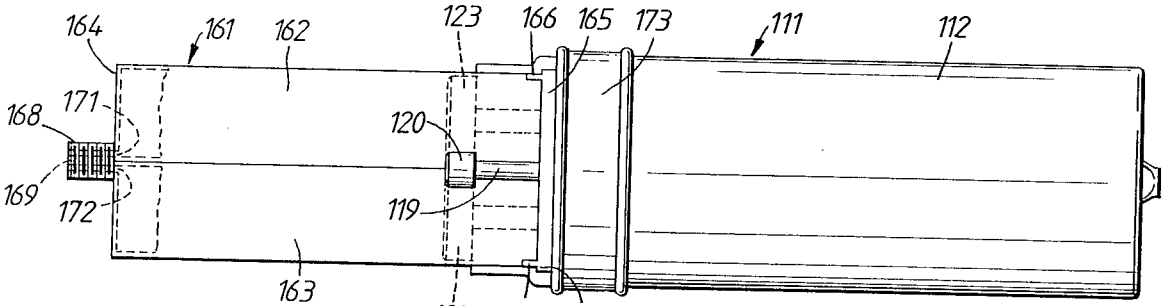
FIG. 7 is a plan view of the dispenser and cartridge shown in FIG. 6.
Figure 8:
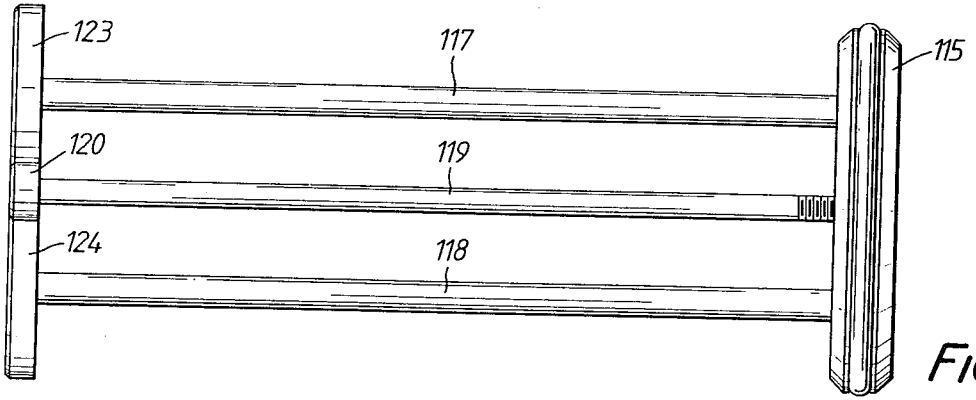
FIG. 8 is a plan view of the piston assembly of the second dispenser.

The cartridge is delivered with a cap screwed to the boss 168, the two chambers 162, 163 filled with the two parts of the material to be dispensed and the open ends closed by displacable sealing membranes. The cap is unscrewed from the boss 168 and replaced by a nozzle similar to that shown in FIG. 2. The piston 115 is then pushed to the rear end of the cylinder 112 by pressing on any of the pistons 123, 124 or 120, the end wall of the cylinder 112 having recesses to receive these pistons. The flange 165 on the cartridge is then entered into the slot 177 and the cartridge is pushed down until the chambers 162, 163 rest against the cradles 175, 176. The dispenser is now ready for operation. When dispensing is to take place the trigger 135 is pressed and compressed air moves the piston 115 and hence the pistons 123, 124 into to the two chambers 161, 163 to dispense material through the boss 168 and the nozzle. The distance that the pistons 123, 124 have advanced in the chambers 162, 163 can be determined visually by looking at the button 120. As seen in FIG. 7, the pistons have advanced approximately one fifth of the length of the cartridge. When the button 120 has advanced to the front end of the cartridge 161 and all the contents have been dispensed, the pistons are returned to their initial position by pushing on the button 120 and the cartridge 161 can then be withdrawn and a new full cartridge slotted into the retainer 174.

I claim:

1. A pneumatic dispenser for a multi-part pasty viscous material comprising a pneumatic cylinder containing a piston; spaced parallel piston rods mounted on said piston and extending from one end of said cylinder, parallel cylindrical containers mounted at said one end of said cylinder and extending away therefrom and containing the components of said material, one of said containers aligned with each of said rods, said rods each having a piston head moveable through one of said containers to forcibly express therefrom the contents of the containers, yoke means secured to said cylinder to hold the containers against the forces exerted by the rods, said dispenser having a single discharge nozzle supported against the pressure exerted by said rods, both said piston and said piston heads being concealed from the operator, an indicator rod mounted on said piston and extending therefrom parallel to said piston rods externally of said containers and moveable with and at the same rate as said piston rods, the ends of said indicator rod being so related to said piston heads that said end informs an operator of the position of said piston heads within said containers whereby the operator can observe the quantity of material remaining in said containers.

* * * * *

UNITED STATES PATENT AND TRADEMARK OFFICE

CERTIFICATE OF CORRECTION

PATENT NO. : 4,871,088

DATED : October 3, 1989

INVENTOR(S) : John P. A. Cox

It is certified that error appears in the above-identified patent and that said Letters Patent is hereby corrected as shown below:

On the title page:
Please change "P.C. Cox (New bury) Limited" to read
-- P.C. Cox (Newbury) Limited --.

Signed and Sealed this

Twentieth Day of October, 1992

*Attest:*

DOUGLAS B. COMER

*Attesting Officer*

*Acting Commissioner of Patents and Trademarks*